US009434089B2

(12) United States Patent
Liu

(10) Patent No.: US 9,434,089 B2
(45) Date of Patent: Sep. 6, 2016

(54) ANTI-KICKBACK DEVICE FOR A TABLE SAW MACHINE

(76) Inventor: Chin-Yuan Liu, Taichung (TW)

( * ) Notice: Subject to any disclaimer, the term of this patent is extended or adjusted under 35 U.S.C. 154(b) by 1854 days.

(21) Appl. No.: 12/686,711

(22) Filed: Jan. 13, 2010

(65) Prior Publication Data

US 2011/0167976 A1 Jul. 14, 2011

(51) Int. Cl.
*B27G 19/02* (2006.01)
*B27G 19/08* (2006.01)

(52) U.S. Cl.
CPC ..... *B27G 19/02* (2013.01); *B27G 19/08* (2013.01); *Y10T 83/2077* (2015.04); *Y10T 83/7734* (2015.04)

(58) Field of Classification Search
CPC .. B27G 19/02; B27G 19/08; Y10T 83/2077; Y10T 83/732; Y10T 83/773; Y10T 83/7734
USPC ..... 83/102.1, 440.2, 477.2, 478
See application file for complete search history.

(56) References Cited

U.S. PATENT DOCUMENTS

| | | | | |
|---|---|---|---|---|
| 7,434,501 | B2 * | 10/2008 | Chuang | 83/478 |
| 7,546,792 | B2 * | 6/2009 | Liu et al. | 83/478 |
| 7,743,691 | B2 * | 6/2010 | Liu et al. | 83/478 |
| 8,104,386 | B2 * | 1/2012 | Chen | 83/102.1 |
| 8,205,533 | B2 * | 6/2012 | Tanaka | 83/478 |
| 2010/0282039 | A1 * | 11/2010 | Jan | 83/102.1 |

* cited by examiner

*Primary Examiner* — Clark F Dexter
(74) *Attorney, Agent, or Firm* — Frommer Lawrence & Haug LLP

(57) ABSTRACT

An anti-kickback device includes a riving knife mounted rearwardly of a saw blade of a table saw machine and having a retaining hole. An elongate mount has a cavity and an insert groove to receive the plate body such that the retaining hole is located in the cavity. A fastening unit includes a post which is received in the cavity, which straddles a top surface of the knife, and which has a radial bore registered with the retaining hole, a detent body disposed in the radial bore and movable to extend into or to be clear of the retaining hole to thereby permit the mount to be secured to or detached from the knife, a tubular actuator which has an inner cam surface configured to move the detent body, and an operating member manually operable to move the actuator.

10 Claims, 13 Drawing Sheets

ANTI-KICKBACK DEVICE FOR A TABLE SAW MACHINE

BACKGROUND OF THE INVENTION

1. Field of the Invention

This invention relates to a table saw machine, more particularly to an anti-kickback device for a table saw machine.

2. Description of the Related Art

A conventional table saw machine generally includes a table top having an opening for extension of a circular saw blade mounted on the table top therethrough, and an anti-kickback device including a riving knife, a guard hood, and a pair of kickback preventing arms. The riving knife is mounted rearwardly of the saw blade along a cutting path of the saw blade such that, as a workpiece is moved over the table top during a cutting operation, the riving knife can enter a split formed in the workpiece by the saw blade so as to prevent cut portions of the workpiece that are positioned on either side of the saw blade from contacting side surfaces of the saw blade. The guard hood is pivotally mounted on an upper portion of the riving knife by a mount to serve as a dust and safety cover. The mount is preferably detachable from the riving knife if not required, such as during replacement of the saw blade. The kickback preventing arms are pivotably mounted on the riving knife and rearwardly of the guard hood and are disposed to hold the workpiece down so as to prevent occurrence of a "kick-back."

SUMMARY OF THE INVENTION

An object of the present invention is to provide an anti-kickback device in which a guard plate unit and a kickback preventing unit can be detachably assembled to a riving knife in a convenient manner and the riving knife can be adjusted to a predetermined height position.

According to this invention, the anti-kickback device includes a riving knife mounted rearwardly of a saw blade along a cutting path, and having a plate body which has a retaining hole. An elongate mount has upper and lower surfaces. The upper surface has a cavity which extends towards the lower surface to form an inner tubular wall, and to terminate at a seat wall. The lower surface has an insert groove which extends upwardly through the seat wall and which extends rearwardly such that, when the plate body is inserted into the insert groove, the retaining hole is located in the cavity. A fastening unit includes a post, a detent body, a tubular actuator, and an operating member. The post has a base portion which is received in the cavity, which cooperates with the inner tubular wall to define a surrounding route, and which is configured to straddle a top surface of the plate body, and a shank portion which extends upwardly of the cavity. The base portion has a radial bore that extends radially and that is registered with the retaining hole. The detent body is disposed in the radial bore to be movable between a retained position, where the detent body is engaged with the retaining hole, and a releasing position, where the detent body is clear of the retaining hole to thereby permit the elongate mount and the fastening unit to be detached from the splitting segment. The tubular actuator is sleeved on the base portion and has an inner cam surface which is configured such that, when the tubular actuator is moved along the surrounding route from an upper position to a lower position, the inner cam surface moves the detent body from the releasing position to the retained position.

The operating member is coupled with the shank portion so as to move the tubular actuator between the upper and lower positions.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
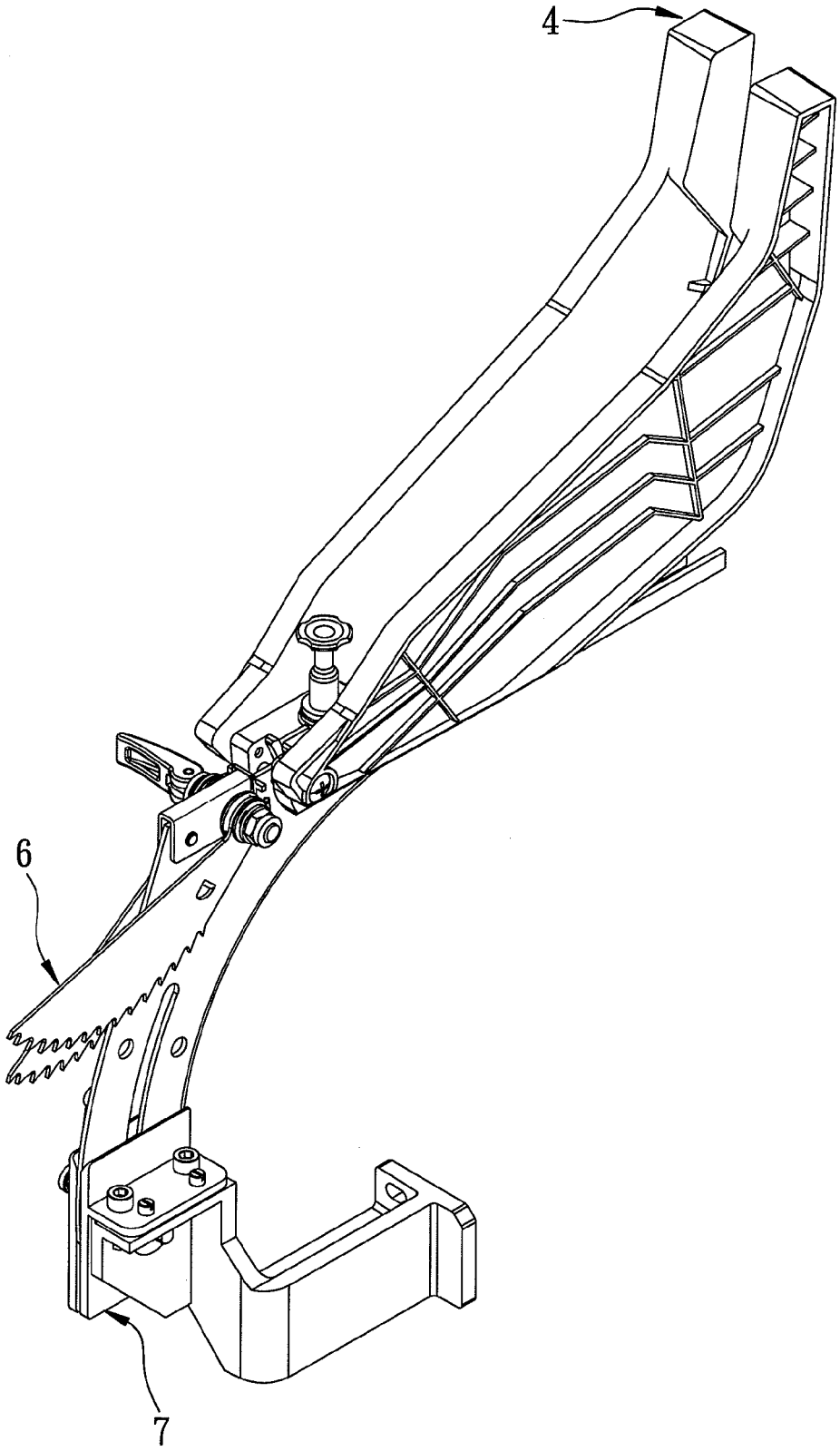
FIG. 1 is a perspective view of the first preferred embodiment of an anti-kickback device according to this invention.

Before the present invention is described in greater detail, it should be noted that same reference numerals have been used to denote like elements throughout the specification.

Referring to FIGS. 1 to 5, the first preferred embodiment of an anti-kickback device for a table saw machine according to the present invention is shown to comprise a riving knife 2, an elongate mount 3, a guide plate unit 4, a fastening unit 5, a kickback preventing unit 6, and a knife adjusting unit 7. The table saw machine (not shown) includes a table top having an opening that extends along a cutting path in a longitudinal direction, and a circular saw blade mounted under the table top and extending through the opening for cutting a workpiece along the cutting path.

The riving knife 2 is mounted rearwardly of the saw blade along the cutting path, and has a plate body 21 which includes a splitting segment 211 and a height-adjustable segment 212 that are disposed opposite to each other in an upright direction. The splitting segment 211 extends forwardly to terminate at a cantilevered end 213, and has two major surfaces 214 opposite to each other in a transverse direction, and a top surface 215 which interconnects the major surfaces 214. The splitting segment 211 has a retaining hole 22 which extends through the major surfaces 214 in the transverse direction, and which is disposed proximate to the cantilevered end 213, and a positioning cutout 25 which is disposed rearwardly of the retaining hole 22 and which has a narrow portion 251 and a wide portion 252. The height-adjustable segment 212 has a sliding slot 23 which extends along a height of the height-adjustable segment 212, and two pairs of upper and lower apertures 241,242 formed at opposite sides of the sliding slot 23.

The elongate mount 3 includes overhang and mount portions 33,30 disposed opposite to each other in the longitudinal direction. The mount portion 30 has upper and lower surfaces 301,302 which are opposite to each other in the upright direction. The upper surface 301 has a cavity 32 which extends towards the lower surface 302 to form an inner tubular wall 321 to terminate at a seat wall 322. The lower surface 302 has an insert groove 31 which extends upwardly through the seat wall 322 and away from the overhang portion 33 such that, when the splitting segment 211 is inserted into the insert groove 31, the retaining hole 22 is located in the cavity 32.

The guide plate unit 4 includes two guard plates 41 which are pivotally mounted on the mount portion 30 on opposite sides of the insert groove 31. Specifically, each of the guard plates 41 has a through hole 421. The mount portion 30 of the elongate mount 3 has two screw holes 422 disposed respectively at two sides of the insert groove 31. A screw bolt 423 extends through the through hole 421 in each of the guard plates 41 to threadedly engage the respective screw hole 422 so as to permit pivotal movement of the respective guard plate 41 relative to the elongate mount 3.

The fastening unit 5 includes a post 51, a detent body 55, a tubular actuator 53, an operating member 52, and a biasing member 54. The post 51 has a base portion 51*a* which is received in the cavity 32 to rest on the seat wall 322, which cooperates with the inner tubular wall 321 to define a surrounding route, and which is disposed to straddle the top surface 215 of the splitting segment 211, and an externally threaded shank portion 51*b* which extends upwardly of the cavity 32. The base portion 51*a* has a radial bore 512 that extends radially and that is registered with the retaining hole 22. The detent body 55 is in the form of a ball, is disposed in the radial bore 512, and is movable between a retained position, where the detent body 55 is engaged with the retaining hole 22 so as to secure the elongate mount 3 to the splitting segment 211, and a releasing position, where the detent body 55 is clear of the retaining hole 22 to thereby permit the elongate mount 3 and the fastening unit 5 to be detached from the splitting segment 211. The tubular actuator 53 is sleeved on the base portion 51*a*, and has an inner cam surface 532 which diverges downwardly such that, when the tubular actuator 53 is moved along the surrounding route from an upper position to a lower position, the inner cam surface 532 moves the detent body 55 from the releasing position to the retained position. The tubular actuator 53 further has an upper flange 531 opposite to the inner cam surface 532. The operating member 52 is threadedly engaged with the shank portion 51*b* such that screw-in and screw-out movements of the operating member 52 relative to the shank portion 51*b* permit movement of the tubular actuator 53 to the lower and upper positions, respectively. The biasing member 54 is disposed to abut against the upper flange 531 and a shoulder of the post 51 so as to bias the tubular actuator 53 to the upper position.

Figure 2:
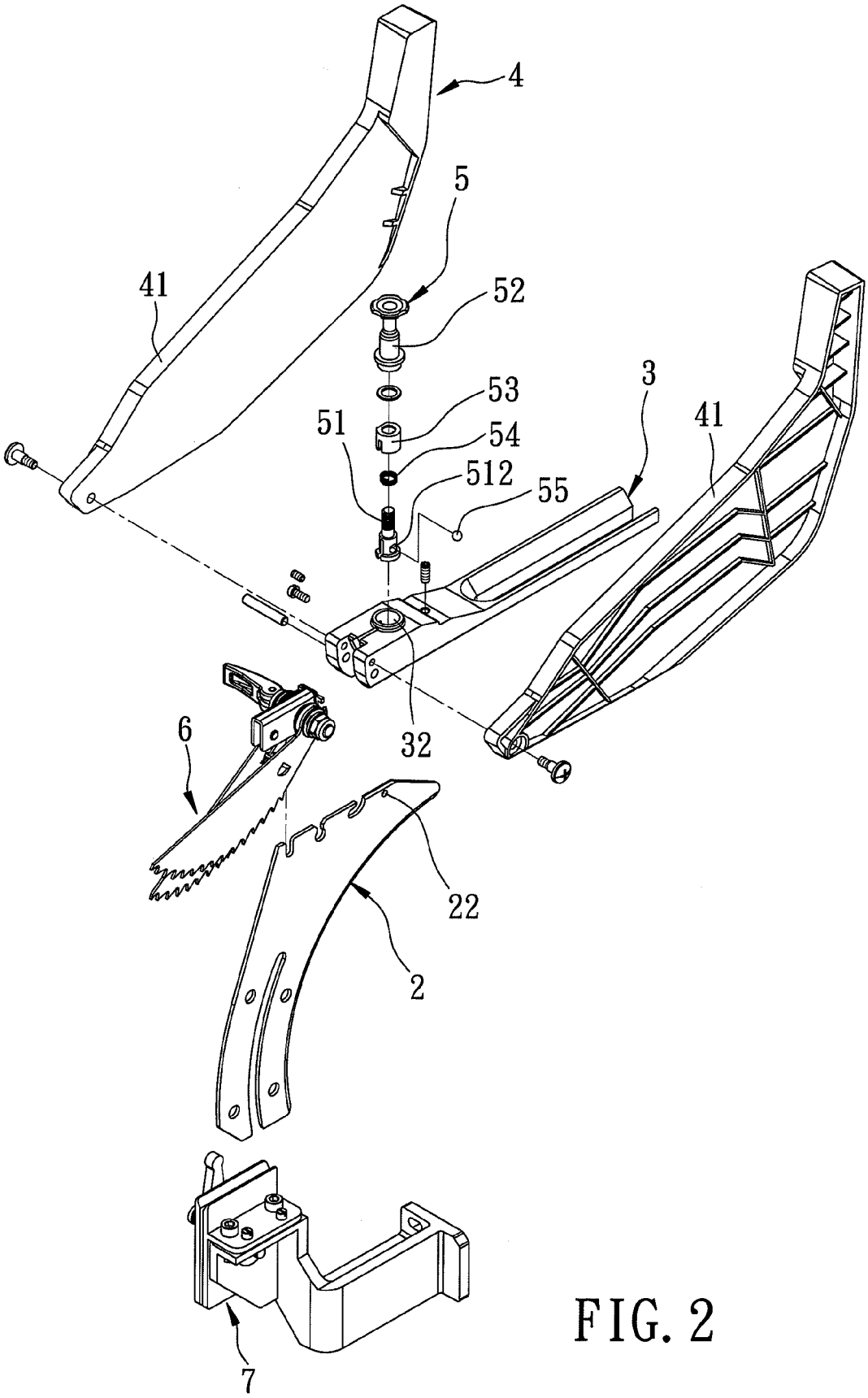
FIG. 2 is an exploded perspective view of the first preferred embodiment.
Figure 3:
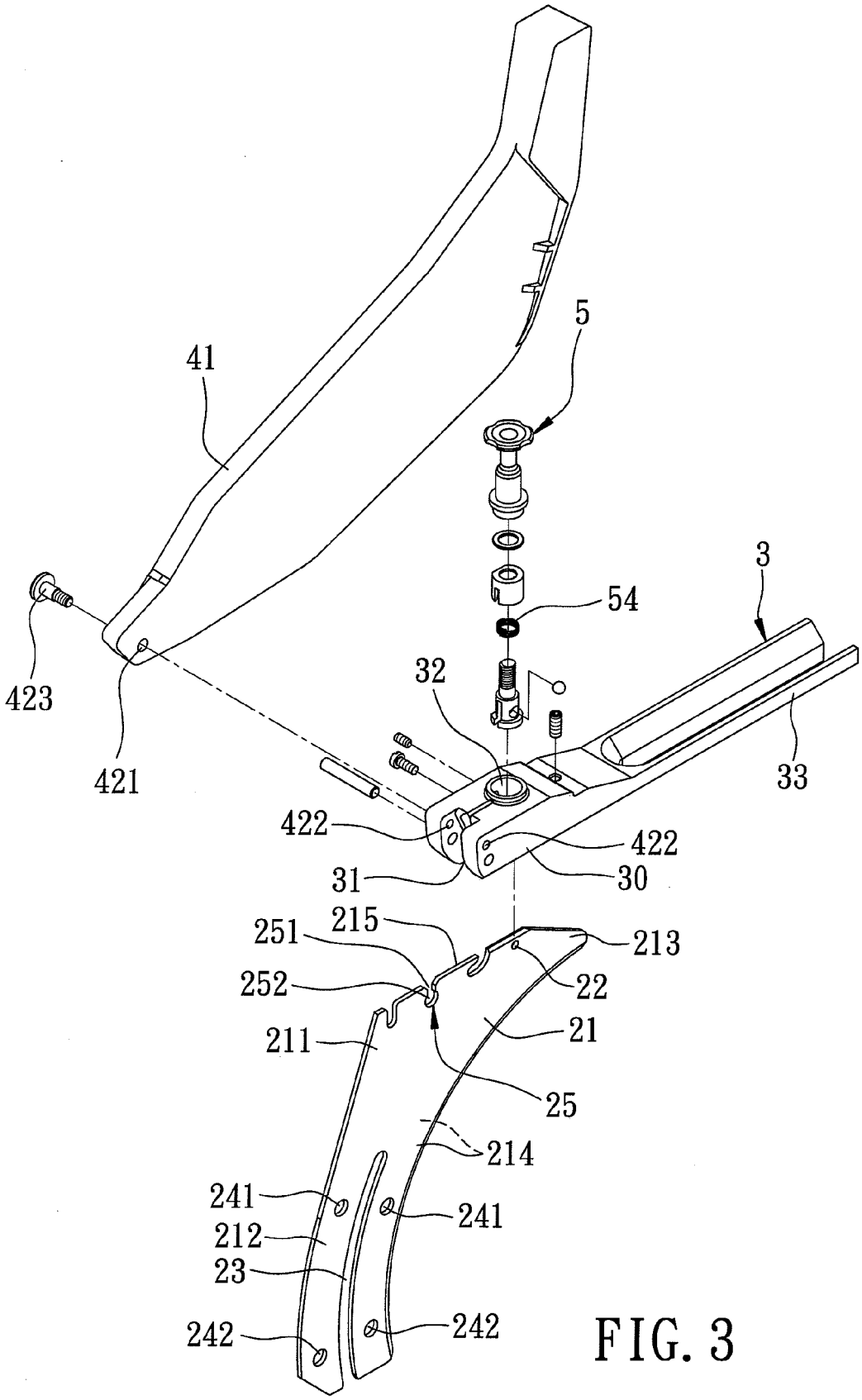
FIG. 3 is an exploded perspective view of a riving knife, an elongate mount and a guard plate of the first preferred embodiment.
Figure 4:
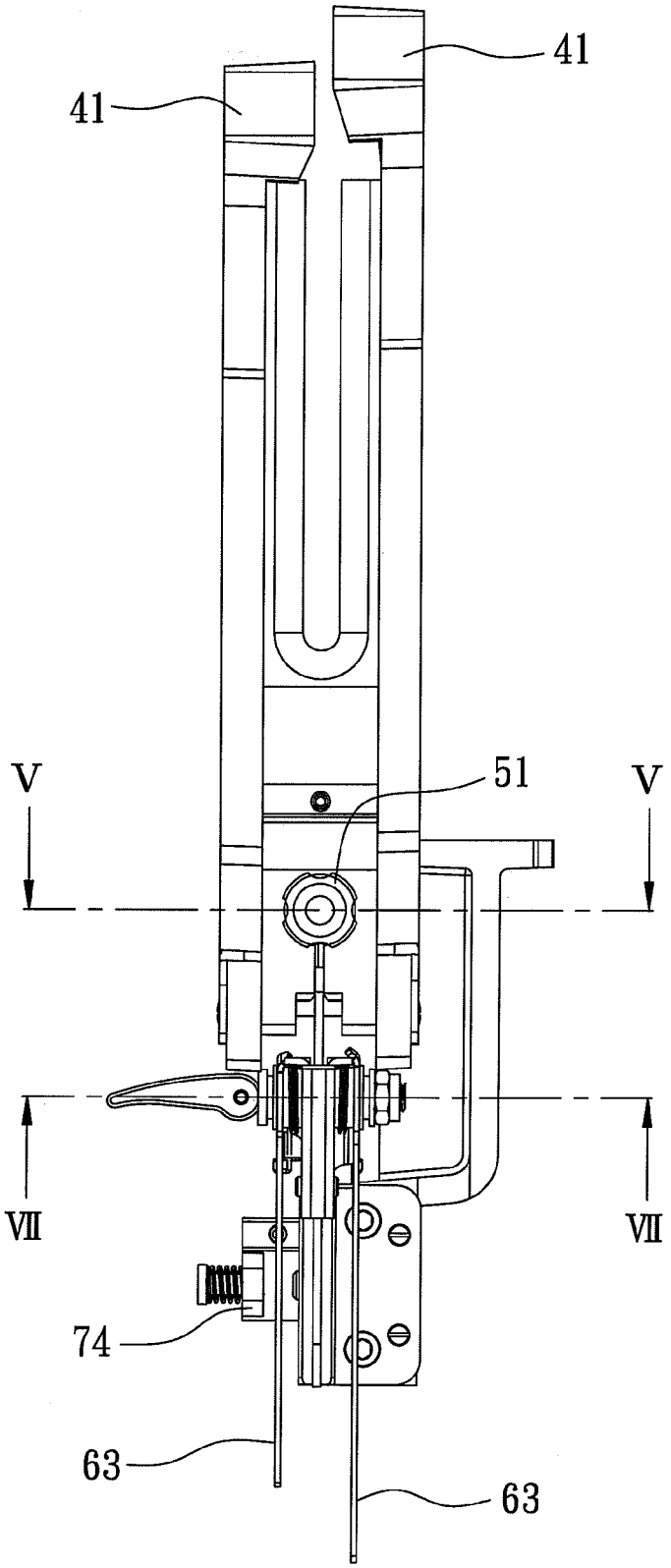
FIG. 4 is a top view of the first preferred embodiment.
Figure 5:
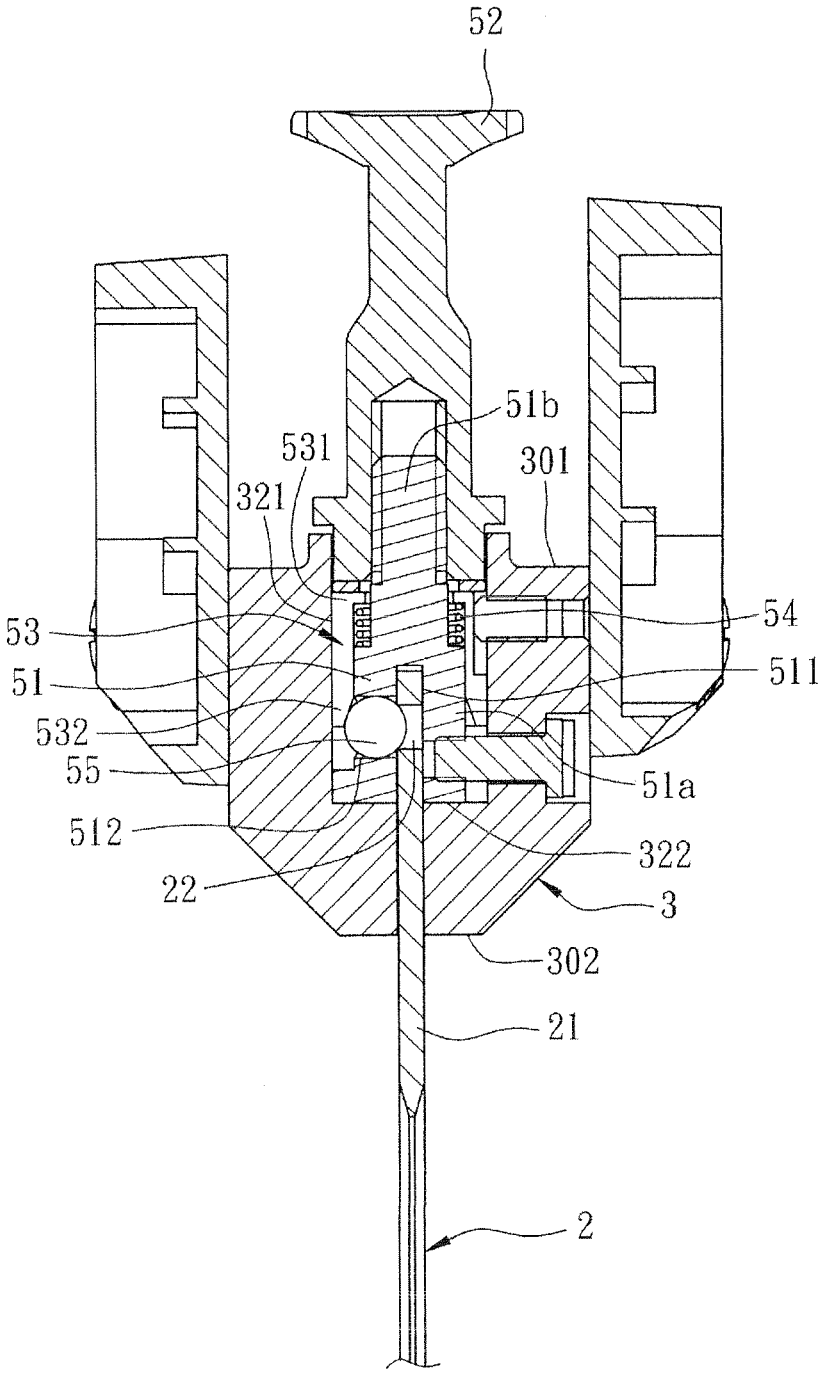
FIG. 5 is a sectional view taken along line V-V of FIG. 4.
Figure 6:
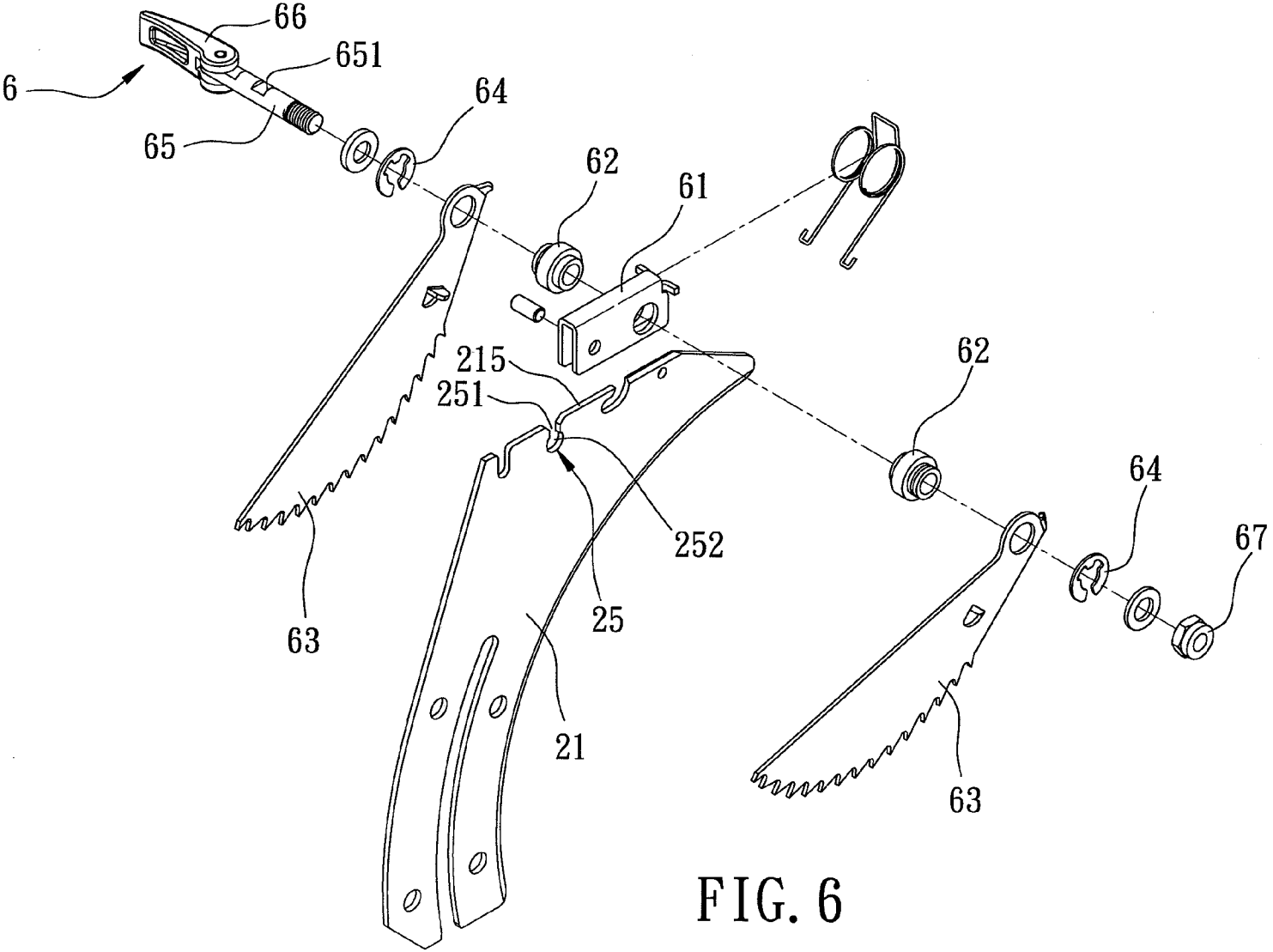
FIG. 6 is an exploded perspective view of the riving knife and kickback preventing arms of the first preferred embodiment.
Figure 7:
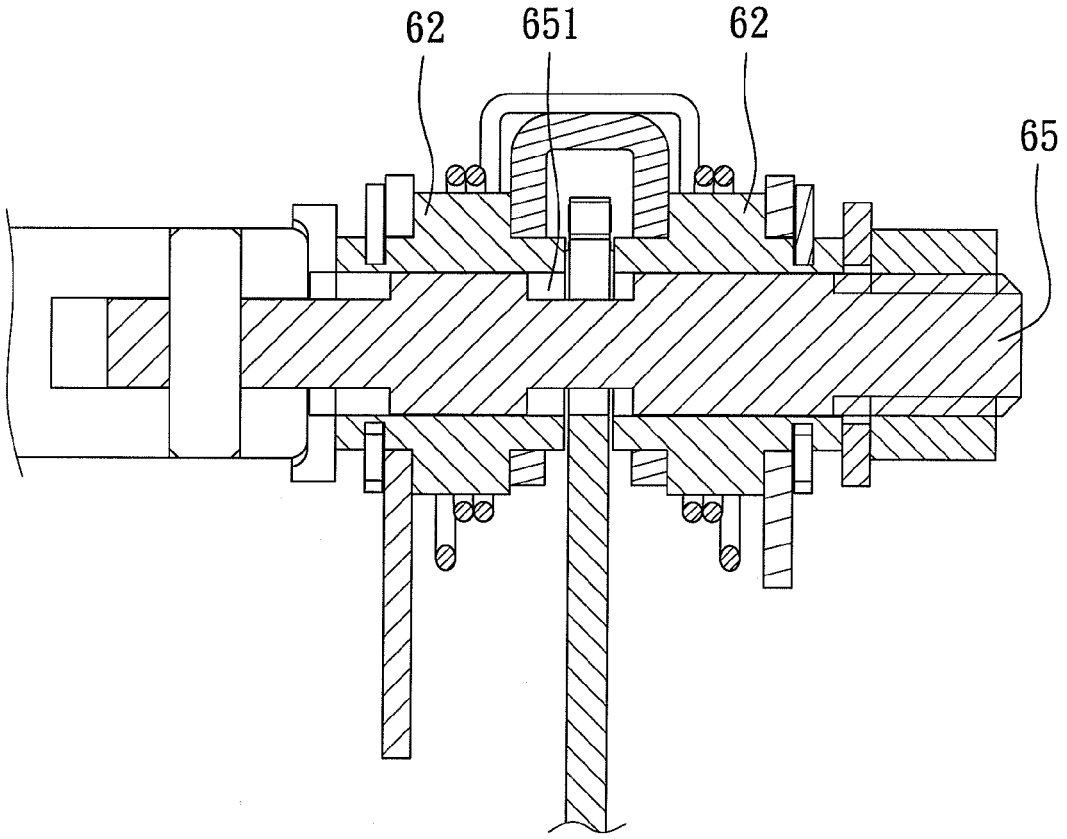
FIG. 7 is a sectional view taken along line VII-VII of FIG. 4.

Referring to FIGS. 2, 6 and 7, the kick-back preventing unit 6 includes a straddling seat 61 which is disposed to straddle the top surface 215 of the riving knife 2, two rotary sleeves 62 which are mounted rotatably and respectively on two sides of the straddling seat 61, two kick-back preventing arms 63 which are mounted respectively on the rotary sleeves 62 and which are respectively retained by two snap rings 64, an axle shaft 65 which extends through the snap rings 64, the arms 63, the rotary sleeves 62, and the positioning cutout 25 in the straddling seat 61 and which is threadedly engaged with a screw nut 67, and a cam lever 66 pivotally mounted on an end of the axle shaft 65 such that turning of the cam lever 66 results in axial movement of the axle shaft 65 to lock the kick-back preventing unit 6 tightly or loosely to the riving knife 2. The axle shaft 65 has a neck segment 651 which is configured to pass through the narrow portion 251 of the positioning cutout 25 so as to permit removal of the axle shaft 65 from the positioning cutout 25.

Figure 8:
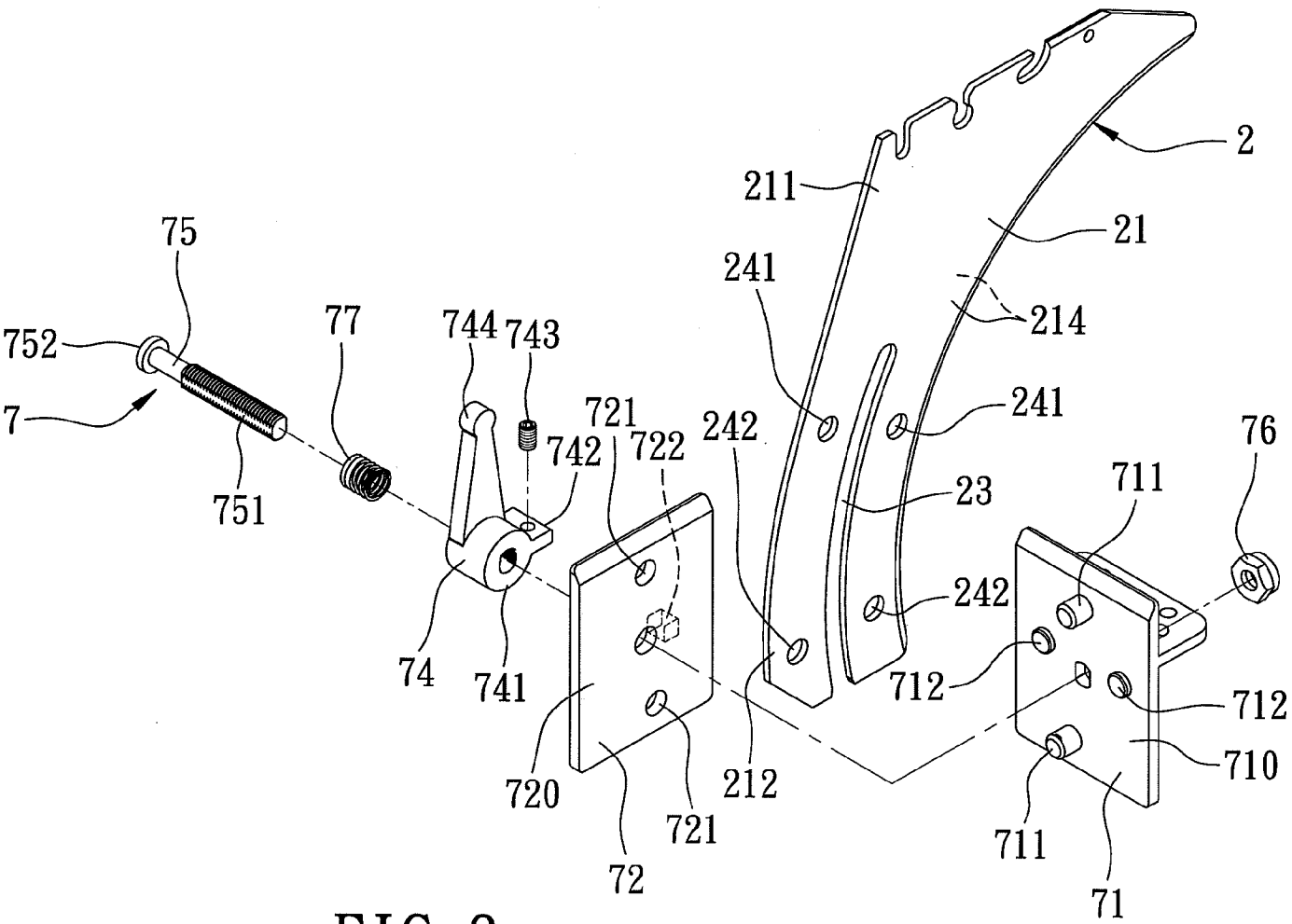
FIG. 8 is an exploded perspective view of the riving knife and a knife adjusting unit of the first preferred embodiment.
Figure 9:
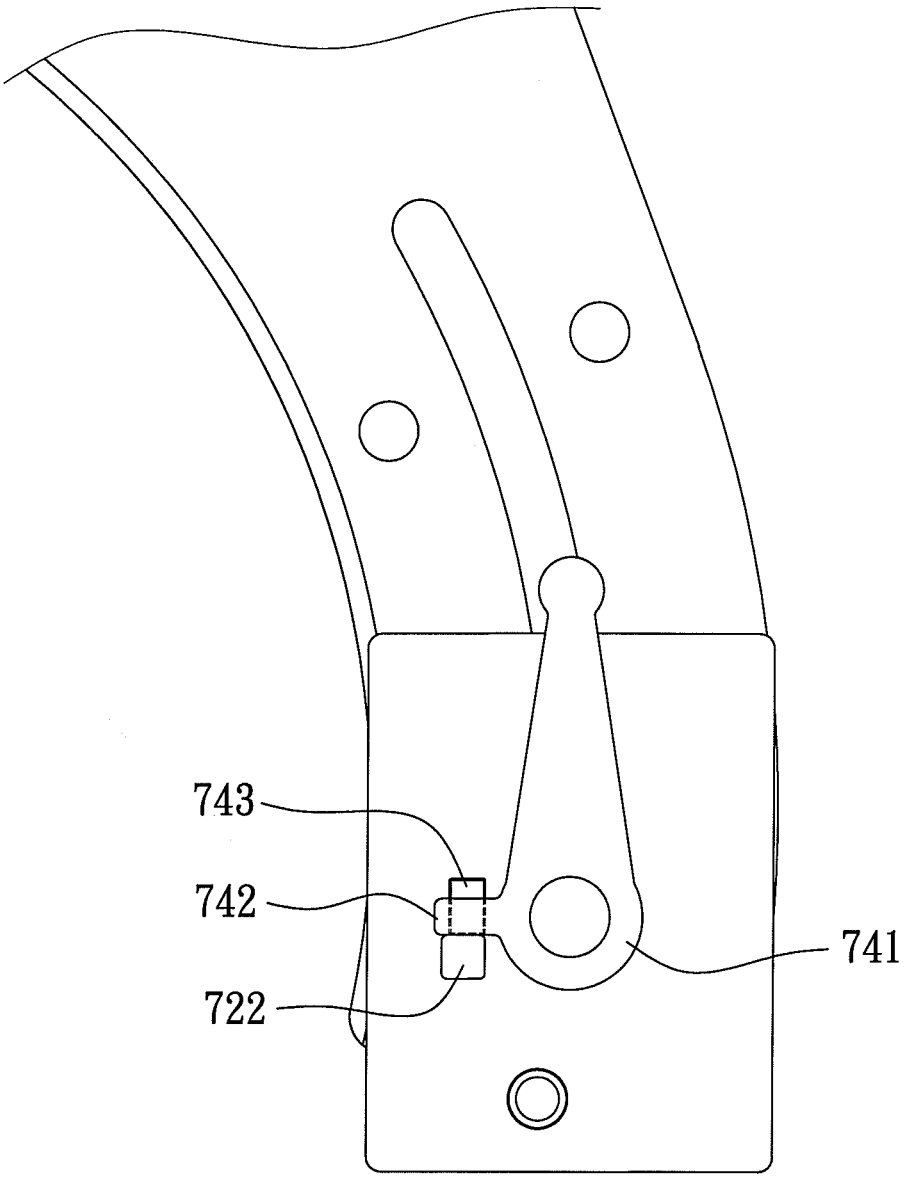
FIG. 9 is a fragmentary side view of the knife adjusting unit of the first preferred embodiment.
Figure 10:
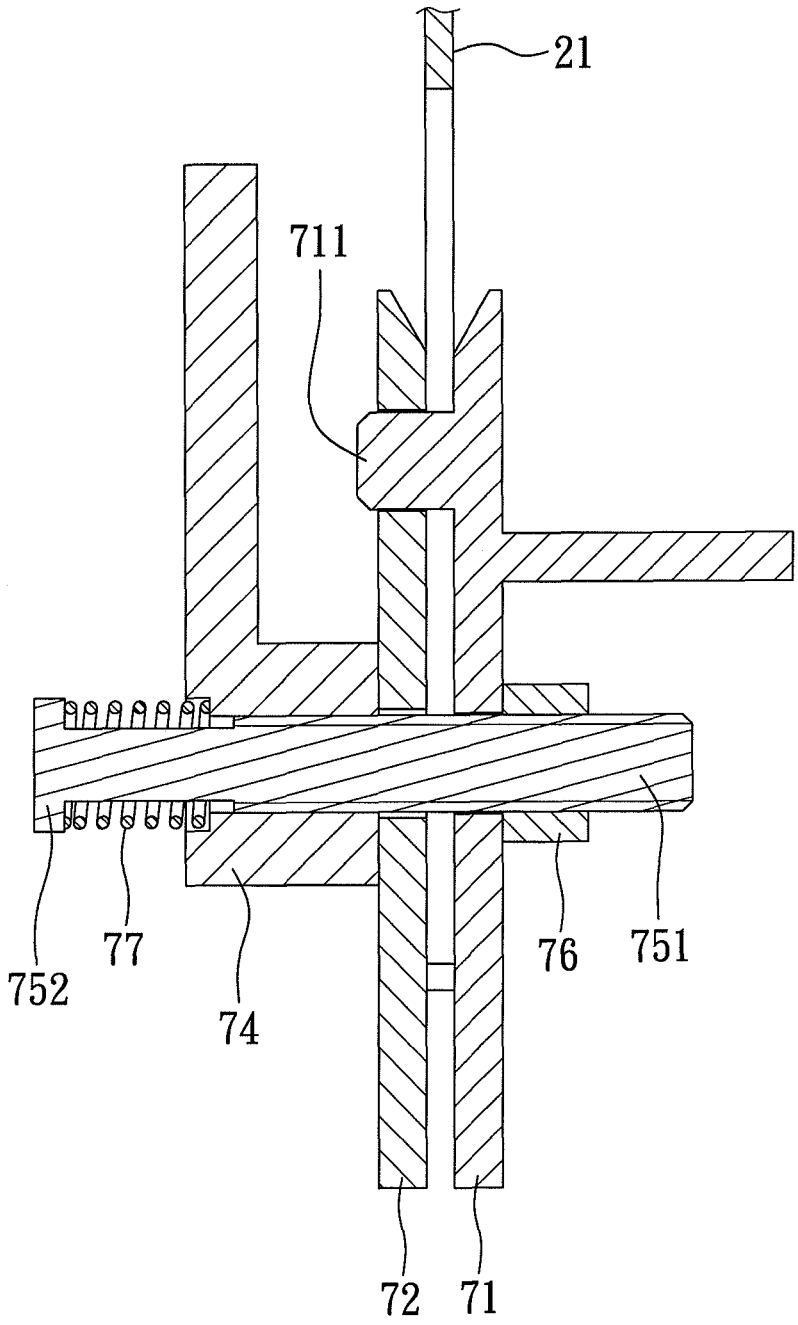
FIG. 10 is a fragmentary sectional view of the knife adjusting unit of the first preferred embodiment.

Referring to FIGS. 8 to 10, the knife adjusting unit 7 includes a first bracket 71, a second bracket 72, a tightening bolt 75, a screw nut 76, a lever 74, and a biasing member 77. The first bracket 71 is adapted to be fixed to the table saw machine, and has a first clamping surface 710 confronting one of the major surfaces 214 of the riving knife 2, a pair of keys 711 extending from the first clamping surface 710 and slidable along the sliding slot 23, and a pair of engaging pins 712 disposed to engage the upper apertures 241 or the lower apertures 242, respectively. The second bracket 72 has a second clamping surface 720 confronting the other one of the major surfaces 214 of the riving knife 2, a pair of retaining bores 721 formed in the second clamping surface 720 and receiving the keys 711, respectively, and a barrier 722 extending away from the second clamping surface 720. The tightening bolt 75 has a head portion 752 and a threaded portion 751 that extends through the first and second brackets 71,72. The screw nut 76 is threadedly engaged with the threaded portion 751 of the tightening bolt 75 so as to bring the first and second clamping surfaces 710,720 to abut against the riving knife 2. The lever 74 has an actuating portion 741 threadedly engaged with the threaded portion 751, and an operated portion 744 which extends radially from the actuating portion 741 and which is manually turnable to bring the actuating portion 741 to press the second bracket 72 toward the first bracket 71. The biasing member 77 is disposed between the actuating portion 741 and the head portion 752 to bias the head portion 752 away from the screw nut 76 so as to keep the screw nut 76 in abutment against the first bracket 71 when the actuating portion 741 is turned to press the second bracket 72. The lever 74 further has a stop portion 742 which extends radially from the actuating portion 741 to abut against the barrier 722 so as to restrict the extent of turning movement of the lever 74. Preferably, an adjusting member 743 in the form of a threaded bolt is disposed on the stop portion 742 and is movable toward or away from the barrier 722 so as to adjust the extent of the turning movement of the lever 74.

The anti-kickback device according to this invention has the following advantages:

1. By rotating the operating member 52, the detent body can be moved between the retained and releasing positions so that the elongate mount 3 and the guard plates 41 can be easily and quickly locked to or released from the riving knife 2.

2. The kickback preventing unit 6 can be quickly and easily locked to or released from the riving knife 2 by turning the cam lever 66 and the axle shaft 65.

3. By turning the lever 74, the first and second brackets 71,72 can be moved toward or away from each other to tightly or loosely abut against the riving knife 2, so that the riving knife 2 can be mounted to the table saw machine and the height position of the riving knife 2 can be easily adjusted.

4. The anti-kickback device according to this invention may be mounted to be inclined with the saw blade of the table saw machine such that the guard plates 41 can entirely cover the saw blade during sawing operations so as to protect the operator.

Figure 11:
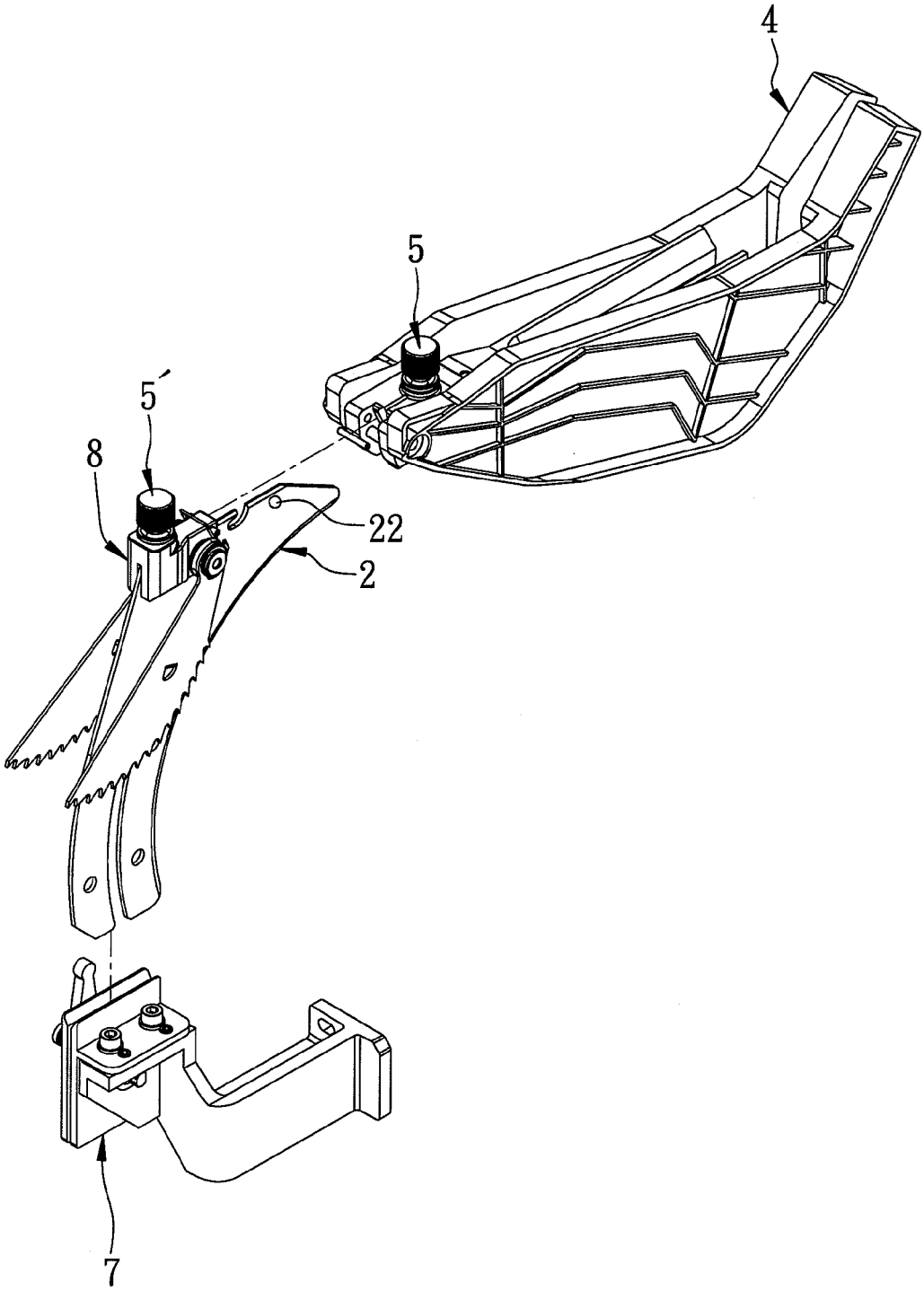
FIG. 11 is an exploded perspective view of the second preferred embodiment of an anti-kickback device according to this invention.
Figure 12:
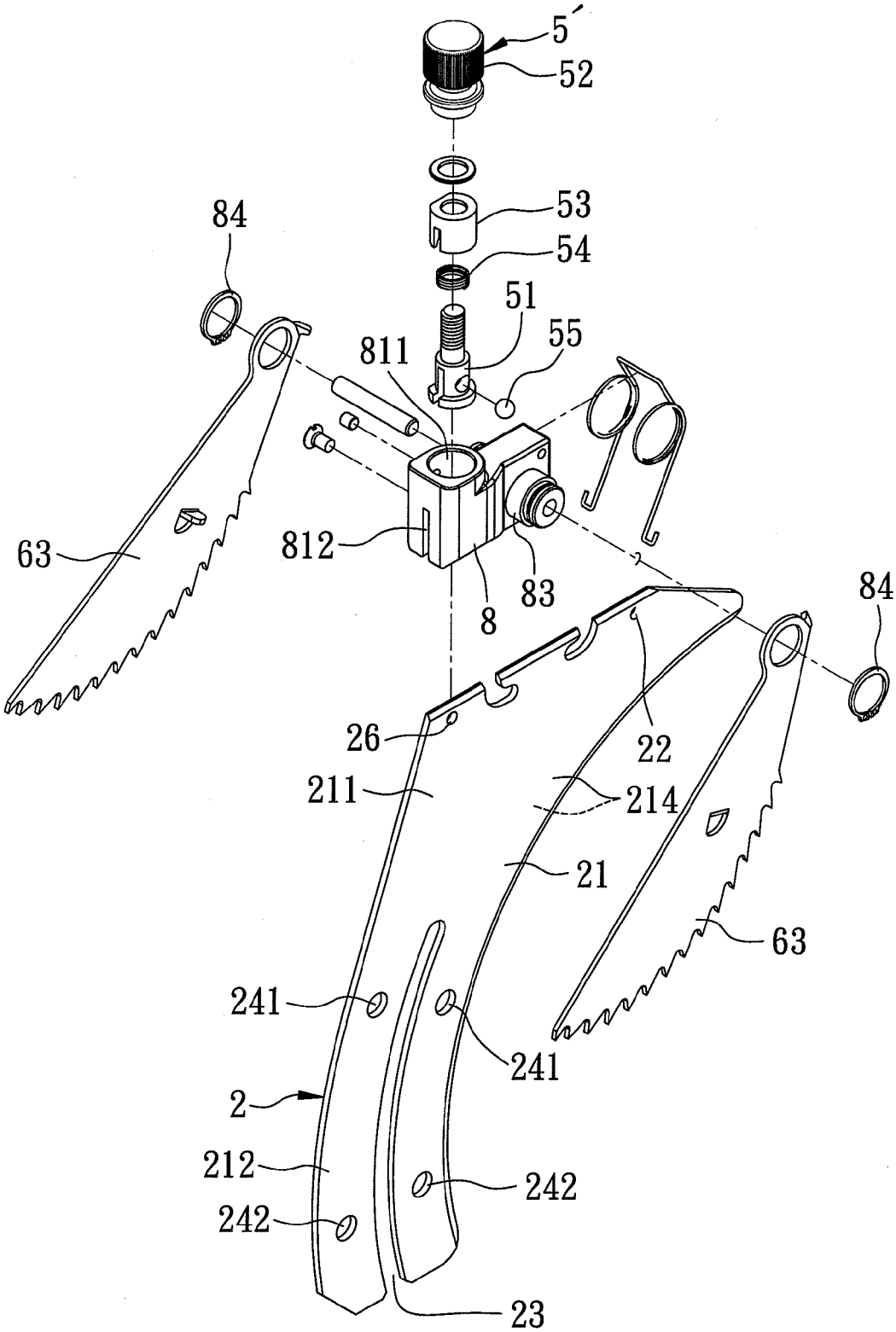
FIGS. 12 and 13 are respectively exploded perspective views of a riving knife, kickback preventing arms, and a locking unit of the second preferred embodiment.
Figure 13:
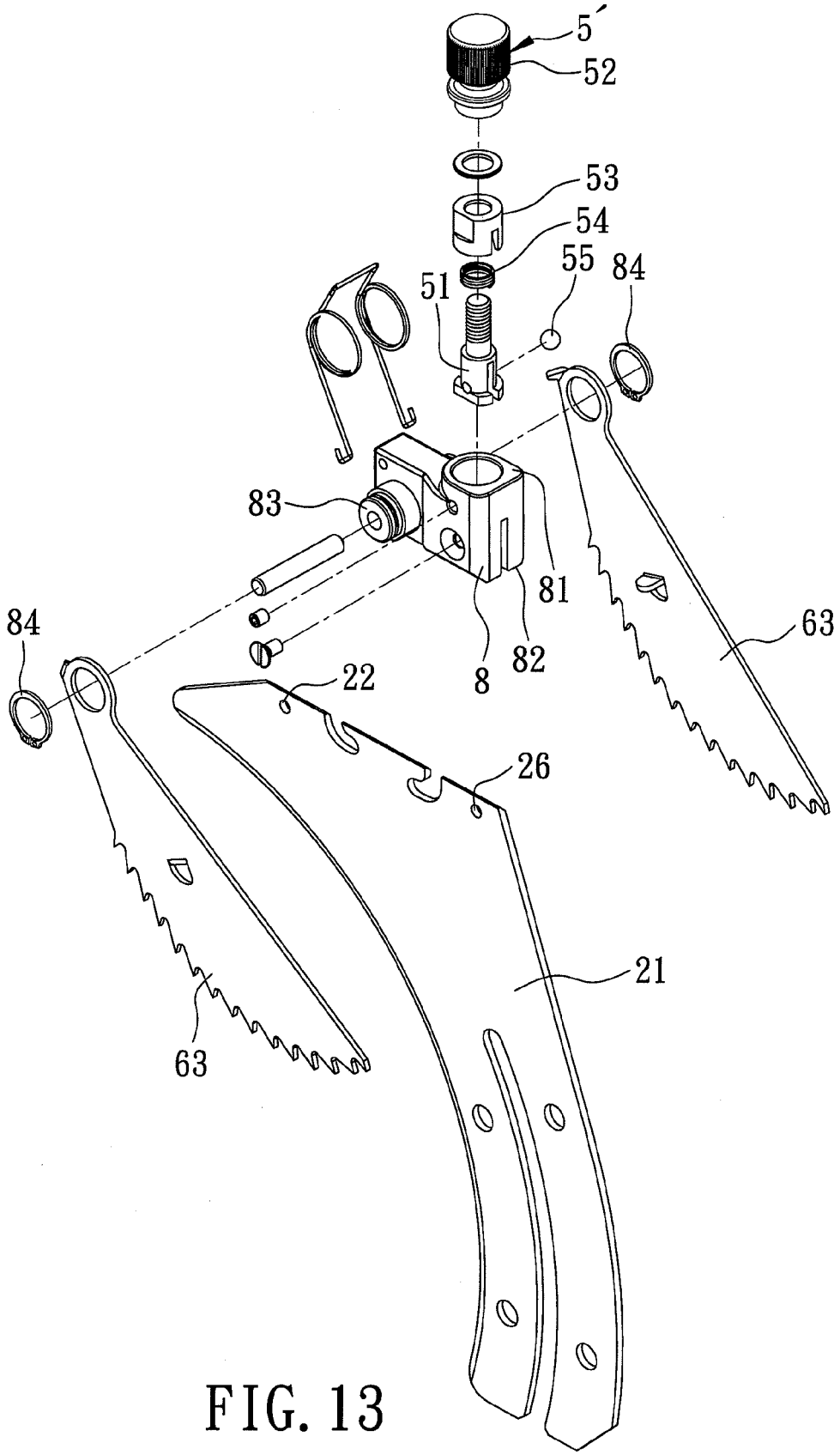

Referring to FIGS. 11 to 13, the second preferred embodiment of an anti-kickback device for a table saw machine according to this invention is similar to that of the first preferred embodiment in construction, except that the kickback preventing arms 63 are assembled to the riving knife 2 by an elongate mount 8 and a fastening unit 5' which are similar to the elongate mount 3 and the fastening unit 5 in construction. Specifically, the plate body 21 has a retaining hole 26 disposed rearwardly of the retaining hole 22. The elongate mount 8 has a cavity 811 extending from the upper surface 81 towards a lower surface 82, and an insert groove 812 extending upwardly and rearwardly for receiving the splitting segment 211 such that the retaining hole 26 is located in the cavity 811. A pair of pivot shafts 83 are mounted on the elongate mount 8 and extend leftwardly and rightwardly from the elongate mount 8 respectively such that the kickback preventing arms 63 are respectively journalled on the pivot shafts 83, and are respectively retained by retaining rings 84.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

I claim:

1. An anti-kickback device for a table saw machine which includes a table top having an opening that extends along a cutting path in a longitudinal direction, and a saw blade mounted under the table top and extending through the opening for cutting a workpiece along the cutting path, said anti-kickback device comprising:

a riving knife adapted to be mounted rearwardly of the saw blade along the cutting path, and having a plate body which includes a height-adjustable segment and a splitting segment that are disposed opposite to each other in an upright direction, said splitting segment having two major surfaces opposite to each other in a transverse direction, and a top surface which interconnects said major surfaces, said splitting segment having a retaining hole which extends through said major surfaces in the transverse direction;

an elongate mount having upper and lower surfaces opposite to each other in the upright direction, said upper surface having a cavity which extends towards said lower surface to form an inner tubular wall and terminates at a seat wall, said lower surface having an insert groove which extends upwardly through said seat wall and which extends rearwardly such that said splitting segment is inserted into said insert groove and said retaining hole is located in said cavity; and a fastening unit including a post having a base portion which is received in said cavity, which cooperates with said inner tubular wall to define a surrounding route, and which straddles said top surface of said splitting segment, and a shank portion which extends upwardly of said cavity, said base portion having a radial bore that extends radially and that is registered with said retaining hole, a detent body disposed in said radial bore and movable between a retained position, where said detent body is engaged with said retaining hole, and a releasing position, where said detent body is clear of said retaining hole to thereby permit said elongate mount and said fastening unit to be detached from said splitting segment, a tubular actuator sleeved on said base portion and having an inner cam surface which is configured such that, when said tubular actuator is moved along the surrounding route from an upper position to a lower position, said inner cam surface moves said detent body from the releasing position to the retained position, and an operating member coupled with said shank portion so as to move said tubular actuator between the upper and lower positions.

2. The anti-kickback device according to claim 1, wherein said base portion of said post is disposed to rest on said seat wall.

3. The anti-kickback device according to claim 1, wherein said operating member is threadedly engaged with said shank portion of said post such that screw-in and screw-out movement of said operating member relative to said shank portion permits movement of said tubular actuator to the lower and upper positions, respectively.

4. The anti-kickback device according to claim 3, wherein said fastening unit further includes a biasing member disposed to bias said tubular actuator to the upper position.

5. The anti-kickback device according to claim 4, wherein said inner cam surface of said tubular actuator diverges downwardly so as to urge said detent body into said retaining hole when said tubular actuator is displaced toward the lower position.

6. The anti-kickback device according to claim 1, further comprising two guard plates which are pivotally mounted on said elongate mount on opposite sides of said insert groove.

7. The anti-kickback device according to claim 1, wherein said height-adjustable segment of said riving knife has a sliding slot which extends along a height of said height-adjustable segment, and two pairs of upper and lower apertures formed respectively at opposite sides of said sliding slot, said anti-kickback device further comprising a knife adjusting unit including a first bracket which is adapted to be fixed to the table saw machine and which has a first clamping surface confronting one of said major surfaces of said riving knife, a key extending from said first clamping surface and slidable along said sliding slot, and a pair of engaging pins disposed to engage said upper apertures or said lower apertures, a second bracket which has a second clamping surface confronting the other one of said major surfaces of said riving knife, and a retaining bore formed in said second clamping surface and receiving said key, a tightening bolt which has a head portion and a threaded portion, said threaded portion extending through said first and second brackets, and a screw nut which is threadedly engaged with said threaded portion of said tightening bolt so as to bring said first and second clamping surfaces to abut against said riving knife.

8. The anti-kickback device according to claim 7, wherein said knife adjusting unit further includes a lever which has an actuating portion threadedly engaged with said threaded portion, and an operated portion which extends radially from said actuating portion and which is manually turnable to bring said actuating portion to press said second bracket toward said first bracket, and a biasing member which is disposed between said actuating portion and said head portion to bias said head portion away from said screw nut so as to keep said screw nut in abutment against said first bracket when said actuating portion is turned to press said second bracket.

9. The anti-kickback device according to claim 8, wherein said second bracket has a barrier which is disposed to restrict an extent of turning movement of said lever.

10. The anti-kickback device according to claim 1, further comprising:

a pair of pivot shafts mounted on opposite sides of said elongate mount; and a pair of kickback preventing arms which are journalled on said pivot shafts, respectively.

* * * * *